United States Patent [19]

Boyadjian

[11] Patent Number: 4,756,345

[45] Date of Patent: Jul. 12, 1988

[54] MACHINE FOR PRODUCING HANGING MEMBERS FOR PACKS OF SHEETS

[76] Inventor: Hratch Boyadjian, Obstgartenstrasse 8, CH-8703 Erlenbach, Switzerland

[21] Appl. No.: 14,665

[22] Filed: Feb. 13, 1987

Related U.S. Application Data

[63] Continuation-in-part of Ser. No. 642,800, Aug. 21, 1984, abandoned.

[30] Foreign Application Priority Data

Aug. 26, 1983 [CH] Switzerland ..... G4661/83

[51] Int. Cl.[4] ..... B21F 45/16

[52] U.S. Cl. ..... 140/71 R; 281/15 A

[58] Field of Search ..... 140/71 R, 92.7, 102, 140/105; 412/39; 283/2; 281/15 A, 15 B

[56] References Cited

U.S. PATENT DOCUMENTS 511,091 12/1893 Neuhaus .
604,041 5/1898 Griswold et al. .
604,647 5/1898 Wolf .
687,753 12/1901 Hoefer et al. .
1,776,874 9/1930 Weston et al. .

FOREIGN PATENT DOCUMENTS 607844 11/1978 Switzerland .
629448 9/1949 United Kingdom .

*Primary Examiner*—Lowell A. Larson
*Attorney, Agent, or Firm*—Helfgott & Karas

[57] ABSTRACT

In a machine for producing a hanging member or hanger from a wire portion, the hanging member is obtained by cutting off the wire portion from a wire unwound from a wire roll. The wire portion is inserted by feed means in the holding and deforming station of the machine, and is centered in a binding of a pack of sheets introduced into the station. Following the closing of the binding holders and movable clamping jaws, a hanging ring is bend in the wire portion by means of a movable bending tool. In the machine, the hanging member is produced fully automatically without any manual intervention and inserted in the binding of the pack of sheet, independently of the type of binding used.

9 Claims, 3 Drawing Sheets

MACHINE FOR PRODUCING HANGING MEMBERS FOR PACKS OF SHEETS

BACKGROUND OF INVENTION

This is a continuation-in-part of application Ser. No. 642,800, filed Aug. 21, 1984, now abandoned.

The present invention relates to a machine for producing hanging members shaped from a wire, a hanging ring and straight wire portions on either side and for introducing the hanging member into the interior of a helical, loop-like or comb-like binding of a pack of sheets, and which is provided on one edge with a perforation system having a thumb-cutout in the center of the edge and in which engages the binding, the hanging ring of the hanging member projecting into a gap formed in the center of the binding.

In the case of packs of sheets, it is known to provide one edge of the sheets with a binding for holding the sheets together, but which enable them to be individually loosely turned. Such packs of sheets are used in e.g. calendars, which are placed upon one another in sheetwise manner and, without opening the binding, can be individually turned on the back of the pack. A hanging member or hanger is used for hanging up or suspending the pack of sheets, and is placed in the interior of the binding and provided with a hanging ring, the latter projecting through a gap in the center of the binding, thus enabling the pack of sheets to be hung on a wall by means of a nail or hook. To enable the sheets to be turned, in the center of the sheet edge in which there are perforations for receiving the binding, there is a thumb cutout , i.e. an edge recess, where the hanging ring projects into the gap in the center of the binding.

The binding can be constructed in numerous different ways. For example, loop bindings and helical bindings shaped in circular manner from a wire are known. In addition, a comb binding is known, which is preshaped from circular plastic members.

The insertion of the hanging member into the binding constitutes a relatively complicated operation, because it must essentially be manually performed. The hanging member is inserted in the binding from the font end thereof, which presupposes that the hanging ring is no larger than the free inner space of the binding.

SUMMARY OF INVENTION

The object of the present invention is to provide a machine for producing hanging members of the aforementioned type that automatically makes it possible to simultaneously produce and insert hanging members for any random binding, independently of the hanging member length.

According to the invention, this problem is solved by providing a machine for producing hanging members shaped from a wire, a hanging ring and straight wire portions on eigher side and for introducing the hanging member into the interior of a helical, loop-like or comb-like binding of a pack of sheets, which is provided on one edge with a perforation system having a thumb cutout in the center of the edge and in which engages the binding, the hanging ring of the hanging member projecting into a gap formed in the center of the binding. The machine includes control means with a processor for the fully automatic operation of the machine and for the digital setting of the wire length for the hanging member; feed means for gripping and drawing off the set wire length from a wire roll, accompanied by simultaneously straightening the wire through straightening means and inserting the wire length into the binding of the pack of sheets inserted in a holding and deforming station; cutting means for cutting the set wire length from the wire of the wire roll, with subsequent centering of the wire length in the pack of sheets by means of the wire moved by the feed means; and holding means arranged in the holding and deforming station for holding the binding and the pack of sheets and clamping means for clamping the wire length, together with shaping means for shaping the hanging ring.

Thus, the present invention advantageously provides a machine for binding packets of sheets of various sizes and which are adapted to be suspended in a suitable location. The machine makes it possible for the suspension means always to be produced and fed automatically, either after or during the fitting of the binding elements to the packet of sheets. Regardless of the type or material of the loop-forming binding elements, this machine produces in a highly efficient manner a binding device having a separate wire suspension means which can be adapted to packets of sheets in all weight and size categories.

BRIEF DESCRIPTION OF DRAWINGS

The invention is described in greater detail hereinafter relative to a non-limitative embodiment and the attached drawings, wherein.

DETAILED DESCRIPTION OF INVENTION

Figure 1:
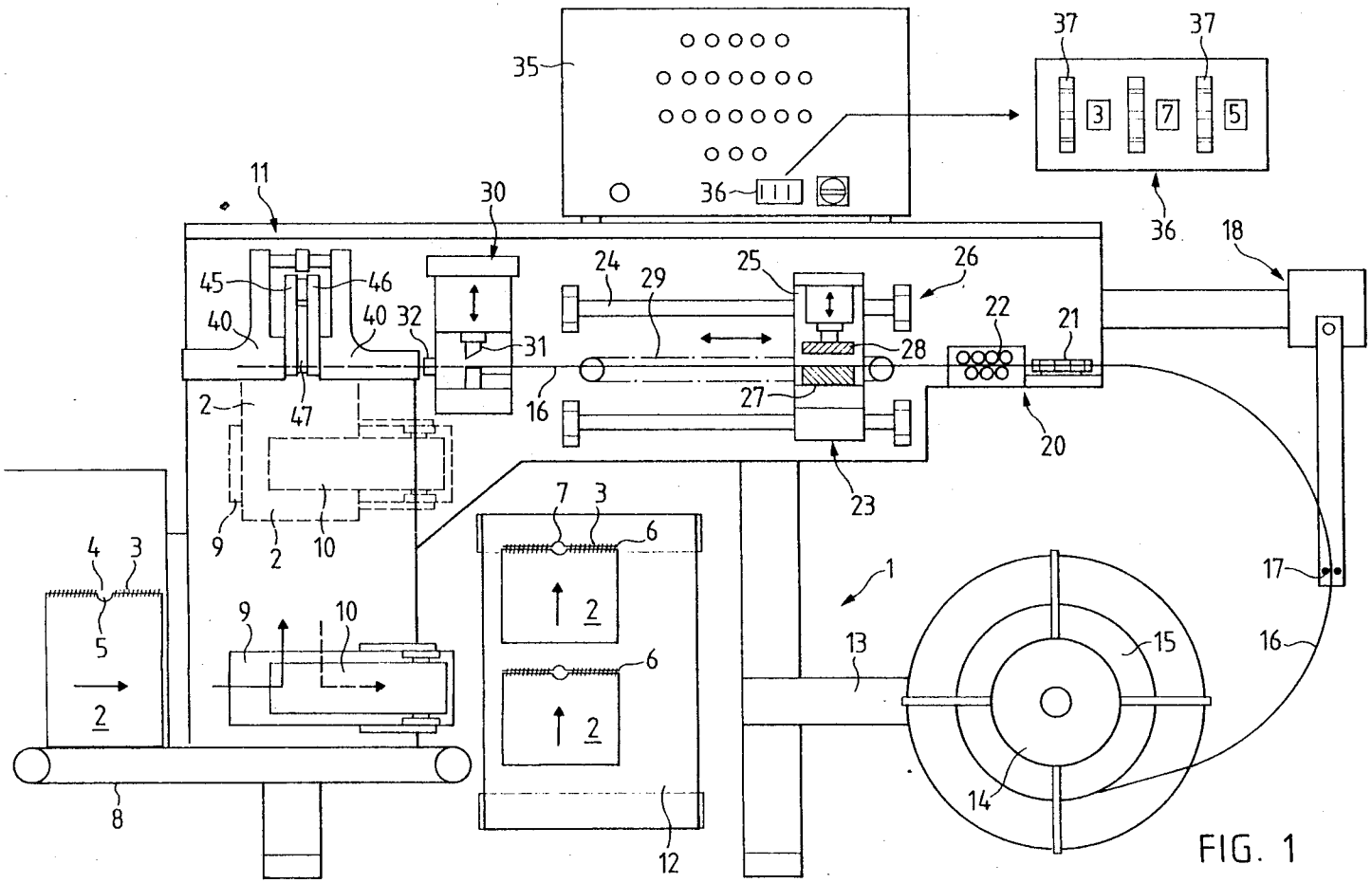
FIG. 1 shows a diagramatic elevation view of a machine for automatically producing suspension members from wire and drawing the wire into the binding of packes of sheets.
Figure 3:
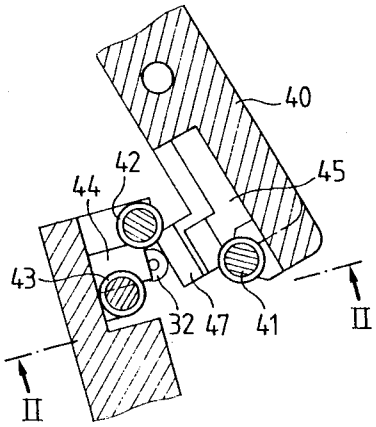
FIGS. 2 and 3 show an elevation and section views as indicated of a holding and deforming station of the machine according to FIG. 1.
Figure 8:
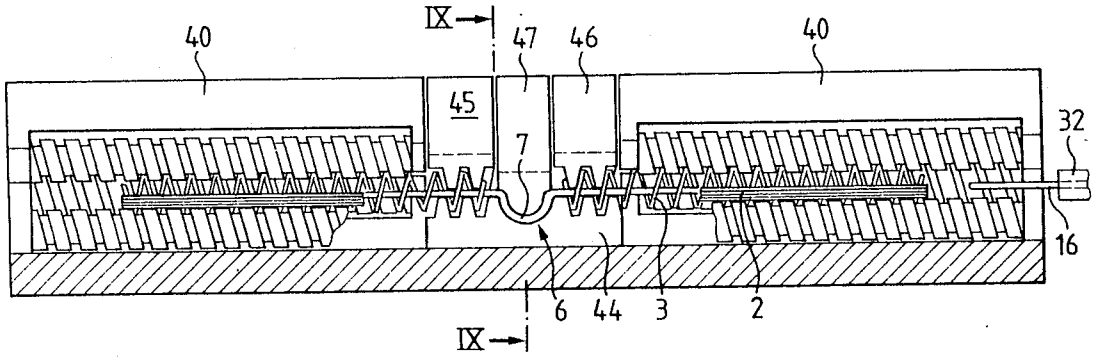

The machine M diagrammatically shown in FIG. 1 for producing hanging members shaped from a wire has a frame 1, on which are arranged all the parts necessary for the automatic production of hanging members and for drawing the same into a binding 3 of a pack of sheets 2. The latter has a thumb cutout 5 in the center of an edge and which is positioned in the vicinity of a gap 4 of the binding 3. After drawing in a hanging or suspension member 6 as shown in FIG. 8, a hanging ring 7 thereof is located in the gap 4.

The packs of sheets 2 provided with the binding 3 in machine 1, pass into the latter via a supply belt 8, where they are individually inserted in a lifting carriage 9 and secured by a clamp strap 10. Lifting carriage 9 together with the pack of sheets 2 is raised into the working position indicated in broken line form, in which binding 3 projects into a holding and deforming station 11, and in which takes place the production and drawing in of the hanging member 6. Following this operation, the pack of sheets 2 is lowered and transferred to a removal belt 12.

A reel 14 with a wire roll 15 is mounted in rotary manner on a shaft on one arm 13 of the machine frame 1. The wire 16 unwound from roll 15 is guided in a guide ring 17 of an unwinding arm 18, and traverses through a wire straightening device 20, which in known manner comprises a plurality of straightening rollers 21, 22, and the straitened wire enters a feed station 23. The latter has a feed carriage 25 guided on rails 24 and on which is constructed a clamping device 26, e.g. provided with a fixed jaw 27 and a movable jaw 28. The feed carriage 25 is moved forwards and backwards by an envelope drive 29, e.g. a chain driven by sprocket wheels.

To the feed station 23 is connected a cutting station 30, which is located directly upstream of the holding and deforming station 11. Cutting station 30 is equipped with a cutting mechanism 31, e.g. a hydraulically or pneumatically operated shear, with which it is possible to remove a wire portion 16' necessary for bending the hanging member 6 from wire 16. The cutting station 30 also has a wire guide 32 permitting the insertion of the separated wire portion 16' into the holding and deforming station 11 through the use of the wire 16.

On the machine M there is provided a control console 35, which has all the control means, e.g. a processor with sensor and operating/control elements necessary for the fully automatic operation of the machine. Alongside the control console 35 there is shown on a larger scale a device 36 for the digital setting of the wire portion to be cut off for the feed length of the feed carriage 25. Setting wheels 37 make it possible to set the desired feed and optionally to set a correction factor.

The machine is operated as follows. After a pack of sheets 2 has been introduced into the holding and deforming station 11 by lifting carriage 9, wire 16 is secured by the clamping device 26 fixed to the feed carriage 25, the latter being advanced in accordance with the setting on control console 35. After the desired feed length has been reached, the cutting mechanism 31 cuts off the advanced wire length 16', which is inserted even further into the holding and deforming station 11 until being centered in binding 3. The operations for bending the wire piece now take place in the holding and deforming station 11, and this is described in detail with respect to FIGS. 2 through 9.

Following the shaping of the hanging member 6, the pack of sheets 2 is removed from the holding and deforming station 11 and brought onto the removal belt 12, from where the pack of sheets 2 is conveyed away.

Figure 2:
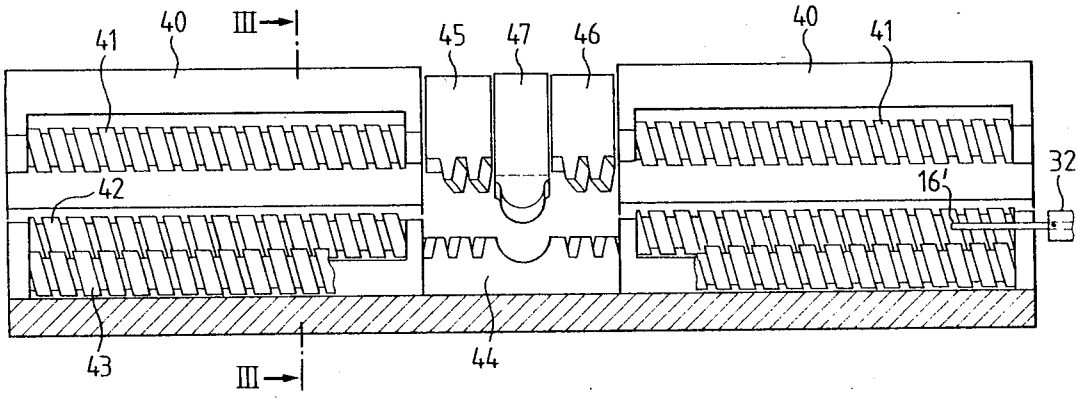

FIG. 2 shows the tools required in the holding and deforming station 11 when in the open state. The tools comprise two binding holders 40 each with section rollers 41–43, between which are arranged a fixed clamping jaw 44 and freely movable clamping jaws 45, 46 with a bending finger 47 located between the jaws 45, 46.

Figure 5:
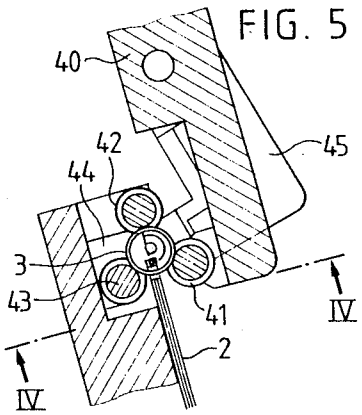
FIGS. 4 and 5 show elevational and sectional view of the holding and deforming station according to FIGS. 2 and 3, and show a pack of sheets provided with a binding being inserted and the binding holders closed.
Figure 4:
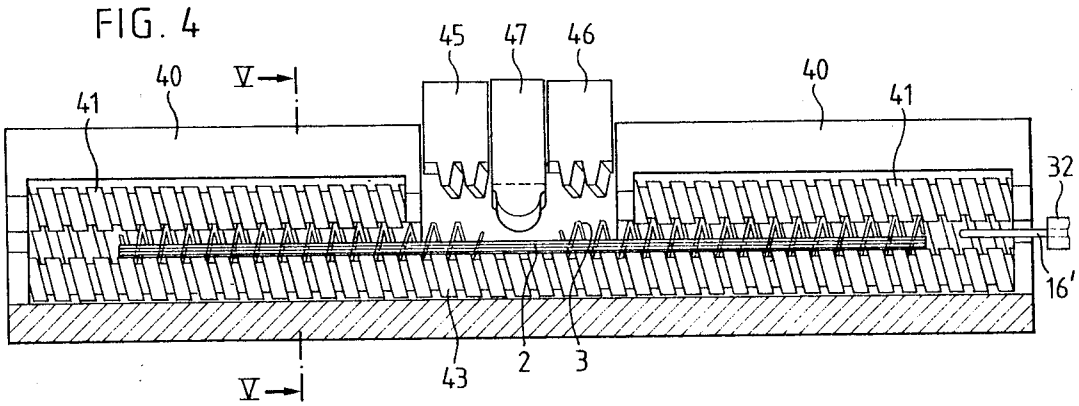

FIGS. 4 and 5 show the pack of sheets 2 and binding 3 inserted, the binding holders 40 being closed together.

Figure 7:
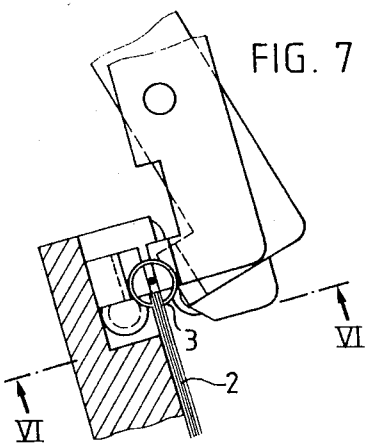
FIGS. 6 and 7 show the holding and deforming station according to FIG. 1 with an inserted and secured hanging wire in the binding.
Figure 6:
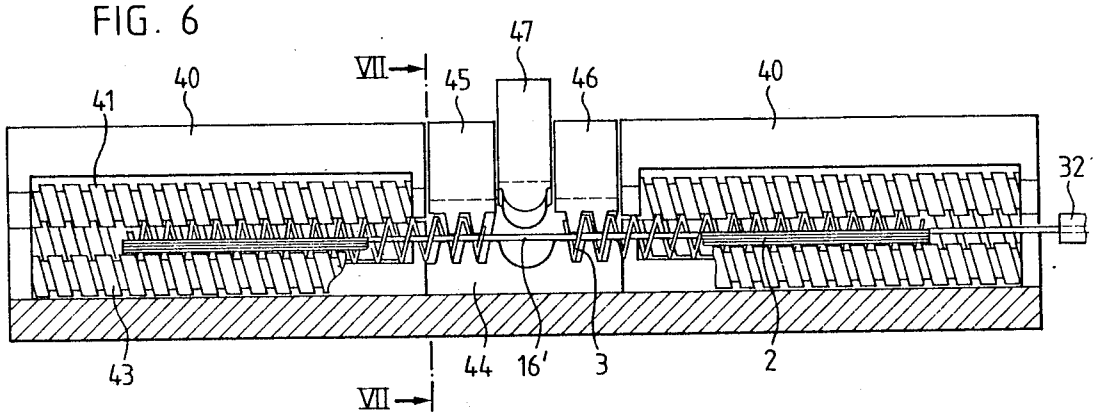

In FIGS. 6 and 7, the wire portion 16' removed from wire 16 is centered in the center of the binding holder tools and binding 3. Through feed carriage 26 the end of wire 16 is used as a ram for inserting wire portion 16'. The movable jaws 45, 46 are now moved together, so that wire portion 16' is fixed in position.

Figure 9:
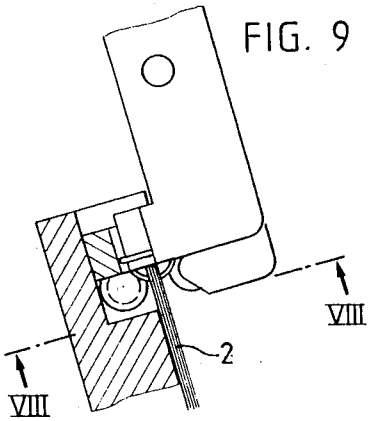
FIGS. 8 and 9 show the holding and deforming station of the machine according to FIG. 1 following the bending of the hanging ring of the wire.

FIGS. 8 and 9 illustrate the bending of hanging ring 7 in wire portion 16' by the inserted bending finger 47.

The tools, i.e. bending holders 40 together with section roller 41, movable jaws 45, 46 and bending finger 47 are then opened, so that the pack of sheets 2 is released and can be conveyed away. The complete sequence of the described operations takes place automatically without any manual intervention. The desired parameters or values are merely set once on control console 35 and then the starting button is depressed for continued operation.

Within the scope of the present invention it is also possible to arrange the individual machine stations in such a way that firstly the hanging member 6 is produced and this member is then drawn into the binding 3 of the pack of sheets 2. The hanging members 6 are produced in the holding and deforming station 11, but which only contains the fixed clamping jaw 44, the movable clamping jaws 45, 46, and the bending finger 47. The hanging members 6 produced are placed in front of the binding 3 of a pack of sheets 2 and inserted in line into the binding 3 there using a ram.

Apart from the fully automatic operation described, the machine has the advantage that the pack of sheets 2 can have any random binding 3, e.g. a helical binding, a loop-type binding or a comb-type binding. The hanging member length can also be chosen at random.

Although this invention has been described broadly and in terms of a preferred enbodiment, it is understood that modifications and variations can be made all within the scope of the invention as defined by the appended claims.

What is claimed is:

1. A machine for producing hanging members shaped from a wire, a hanging ring and straight wire portions on either side and for introducing the hanging member into the interior of a helical, loop-like or comb-like binding of a pack of sheets, which is provided on one edge with a perforation system having at least one thumb cutout in the center of the edge and in which engages the binding, the hanging ring of the hanging member projecting into a gap formed in the center of the binding, wherein are provided control means with a processor for the fully automatic operation of the machine and for the digital setting of the wire length for the hanging member; feed means for gripping and drawing off the set wire length from a wire roll, accompanied by simultaneously straightening the wire through straightening means and inserting the wire length into the binding of the pack of sheets inserted in a holding and deforming station; cutting means for cutting the set wire length from the wire of the wire roll, with subsequent centering of the wire length in the pack of sheets by means of the wire moved by the feed means; and holding means arranged in the holding and deforming station for holding the binding and the pack of sheets and clamping means for clamping the wire length, together with shaping means for shaping the hanging ring.

2. A machine according to claim 1, wherein conveying means are also provided for the successive supply of the packs of sheets to the holding means and for removing the packs from the holding means.

3. A machine for producing hanging members shaped from a wire, a hanging ring and straight wire portions on either side and for introducing the hanging member into the interior of a helical, loop-like or comb-like binding of a pack of sheets, which is provided on one edge with a perforation system having a thumb cutout in the center of the edge and in which engages the binding, the hanging ring of the hanging member projecting into a gap formed in the center of the binding, wherein are provided control means with a processor for the fully automatic operation of the machine and for the digital setting of the wire length for the suspension member; feed means for gripping and drawing off the set wire length from a roll, while simultaneously straightening the wire through straightening means; cutting means for cutting the set wire length from the wire roll; feed means for inserting the wire length by means of the wire into a holding and deforming station, which has clamping means for clamping the wire length and deforming means for bending the hanging ring in the center of the wire length; and drawing in means for inserting the completely shaped hanging member in the packs of sheets.

4. A machine according to claim 1, wherein the feed means have a feed carriage guided on rails and which is reciprocated by an envelope drive, and on which is supported a clamping device having a fixed jaw and a movable jaw.

5. A machine according to claim 3, wherein the feed means have a feed carriage guided on rails and which is reciprocated by an envelope drive and on which is supported a clamping device having a fixed jaw and a movable jaw.

6. A machine according to claim 4, wherein the cutting means have a pneumatically or hydraulically operable shear.

7. A machine according to claim 6, wherein on the outlet side of the cutting means is provided a wire guide for guiding the wire when centering the wire length in the holding and deforming station.

8. A machine according to claim 7, wherein the holding and deforming station has a bending tool with a fixed clamping jaw and a movable deforming jaw, and on either side of the latter there are movable clamping jaws for clamping the wire length.

9. A maching according to claim 8, wherein on either side of the movable clamping jaws and the fixed clamping jaws, binding holders with section rollers are arranged in the holding and deforming station and for inserting a pack of sheets provided with a binding, one section roller being mounted in the movable part of the binding holder and the other section rollers mounted in the fixed part of the binding holder.

* * * * *